United States Patent [19]

Bondhus et al.

[11] 4,246,811

[45] Jan. 27, 1981

[54] BALL HEAD POLYGONAL WRENCH

[75] Inventors: John R. Bondhus, Monticello, Minn.; Fred L. Heim, Millersville, Pa.

[73] Assignee: Bondhus Corporation, Monticello, Minn.

[21] Appl. No.: 77,938

[22] Filed: Sep. 24, 1979

[51] Int. Cl.[3] ..... B25B 13/48

[52] U.S. Cl. ..... 81/436

[58] Field of Search ..... 81/71; 64/7

[56] References Cited

U.S. PATENT DOCUMENTS

| | | | |
|---|---|---|---|
| 3,213,719 | 10/1965 | Kloack | 81/71 |
| 3,940,946 | 3/1976 | Andersen | 64/7 |
| 4,080,079 | 3/1978 | Waara | 64/7 |

FOREIGN PATENT DOCUMENTS

| | | | |
|---|---|---|---|
| 548615 | 10/1942 | United Kingdom | 81/71 |
| 876781 | 9/1961 | United Kingdom | 81/71 |

*Primary Examiner*—James L. Jones, Jr.

*Attorney, Agent, or Firm*—Kinney, Lange, Braddock, Westman and Fairbairn

[57] ABSTRACT

A wrench with a polygonal cross section includes an integral drive shank portion, a neck portion, and a drive head portion in a coaxial relationship along a central axis. The head portion has curved sides corresponding to the same number of sides as the shank portion with the radius of curvature of the sides being displaced outwardly from the longitudinal axis of the wrench so that each side substantially conforms to a portion of an ellipse whose minor axis lies along the central axis. The surface of the neck portion substantially conforms to an inwardly curved surface of revolution whose axis of revolution lies along the central axis of the wrench.

8 Claims, 5 Drawing Figures

BALL HEAD POLYGONAL WRENCH

BACKGROUND OF THE INVENTION

1. Field of the Invention

The present invention relates to tools that are used to turn fasteners having polygonal sided sockets. In particular, the present invention relates to tools having a rounded head, thereby having the capability of turning such fasteners in a non-coaxial relationship.

2. Description of the Prior Art

The previously known prior art contains several tools that have a rounded or a circular head used to turn fasteners that have polygonal sockets or recesses. The purpose of the rounded head is to provide the capability of turning the fastener in an angular relationship with respect to the fastener's axis. This capability is important where the fastener is located in a hard to reach place. In this situation. it is necessary to insert the tool and turn it through a partial turn, then withdraw the tool and reinsert it into the socket, and go through another partial turn, and so on, wasting both time and effort.

The prior art, in attempting to solve this problem, has approached several limitations. The first limitation is the angle with respect to the axis of the fastener in which the tool can be used to turn the fastener without binding the fastener. British Pat. No. 548,615 shows a hex wrench with this limitation. FIG. 1 displays at how small of an angle the hex wrench is able to engage the socket without binding. This is due to the nature of the curvature of the ball head. In an effort to enable even this small an angle of tilting to take place, the neck is made relatively small in diameter. One advantage of using hex wrenches is their ability to withstand great angular forces without twisting. In forming the neck portion, the inherent strength of the wrench can be compromised if the neck portion is made too small in diameter. Manufacturing a tool with a small neck diameter risks the chance of the head being twisted off under great force.

British Pat. No. 876,781 shows a tool in FIG. 1 that circumvents the problem of binding by providing a certain amount of play "between the ball-shaped head and the socket". This is evident from FIG. 2. This, however, tends to increase the chance of the edges of the ball becoming rounded when substantial forces are applied to the tool to cause the tool to slip with respect to the socket.

U.S. Pat. No. 3,940,946 shows a universal joint with a head portion larger than its shaft. This prevents the use of standard polygonal stock. In order to use standard polygonal stock, the head can be no larger than the shank or shaft. Furthermore, the sides of the head are not of uniform width. While this might be satisfactory with a universal joint where the head and socket can be matched, it would preclude the use of a head of this type as an element of a wrench where the wrench must be used with standard socket types of screw fasteners. Moreover, the patentee depends upon the use of an elastomeric material over the head to prevent binding in the socket.

U.S. Pat. No. 4,080,079 shows a universal joint in which the sides are arcuately curved with substantially the same radius as the radius of the ball portion. As will be pointed out later in the specification, this does not result in the maximum amount of tilting for a given shank size.

SUMMARY OF THE INVENTION

The present invention includes a tool with a polygonal cross section having an integral drive shank portion, a neck portion, and a drive head portion in a coaxial relationship along a central axis. The curvature of the drive head portion is especially designed to permit the maximum amount of tilting of the tool without binding as it is turned, while at the same time providing a relatively thick neck portion. This is accomplished by providing the head portion with curved sides corresponding to the same number of sides as the shank portion, with the center of curvature of the surfaces of the curved sides being displaced outwardly from the longitudinal axis of the tool so that the curved sides substantially conform to a portion of an ellipse. The surface of the neck portion may take a variety of forms but is preferably in the form of an inwardly curved surface of revolution whose axis of revolution lies along the central axis of the tool.

The curved sides of the head portion substantially conform to the end portions of an ellipse whose minor axis lies along the central axis of the tool. The major axis of the elliptical sides has a pair of foci wherein the distance from the minor axis to each focus is defined substantially by $\frac{1}{2}D\ (1-\cos\sigma)$wherein D is the distance between opposed sides of the tool and $$\sigma = \frac{360^\circ}{2\ (\text{No. of sides})}.$$

The distance from each focus to the nearest intercept of the major axis with the end portion is defined further by the equation $\frac{1}{2}D \cos\sigma$.

The neck portion which is defined by an inwardly curved surface of revolution is tangential to the elliptical surface of the head portion at the point of confluence.

Since the head can be of the same diameter as the shank, the tool of the present invention can be manufactured from the same stock as tools not having the elliptical head portion. This construction, of course, eliminates the extra cost that results in having specially formed pieces of steel in order to accomodate a larger head portion.

DETAILED DESCRIPTION OF THE PREFERRED EMBODIMENT

Figure 1:
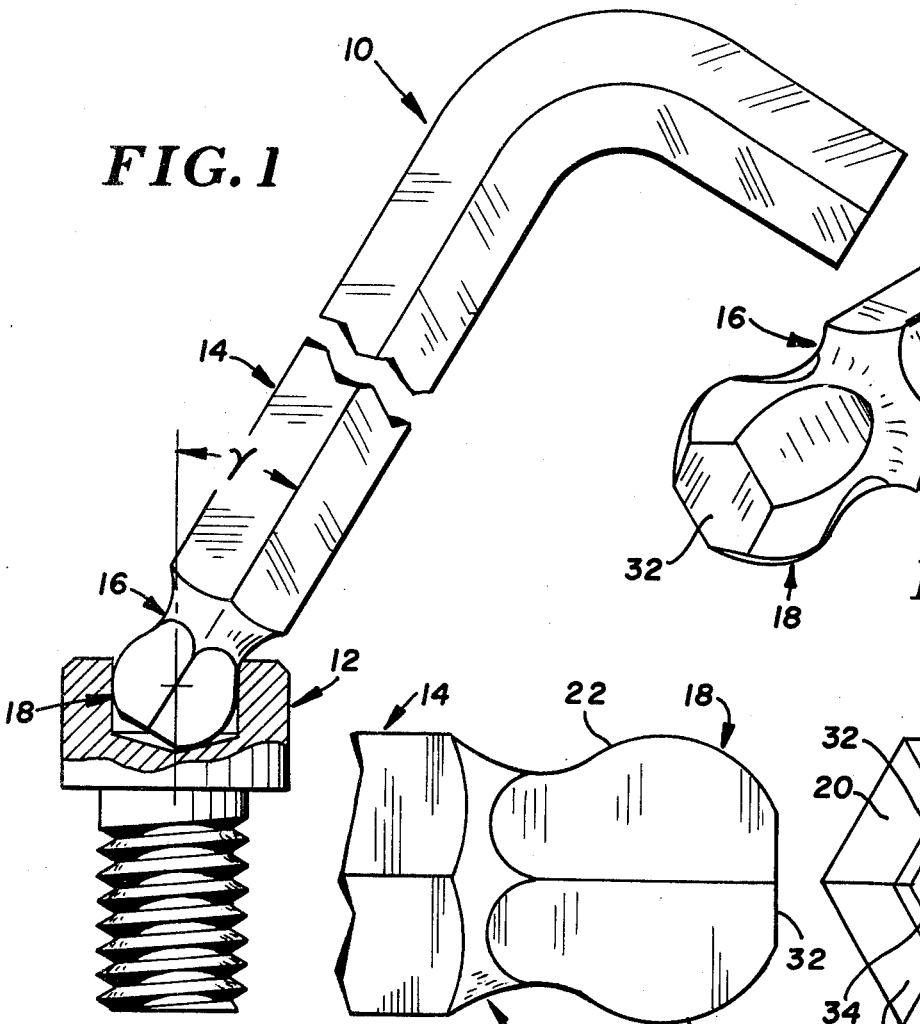
FIG. 1 is a side elevational view showing the tool of the present invention engaging a hex socket screw.

In FIG. 1, the tool of the present invention in the preferred form of a hex wrench is shown generally at 10. The hex wrench 10 is shown engaging screw 12 in angular relationship indicated by the angle $\nu$.

Figure 2:
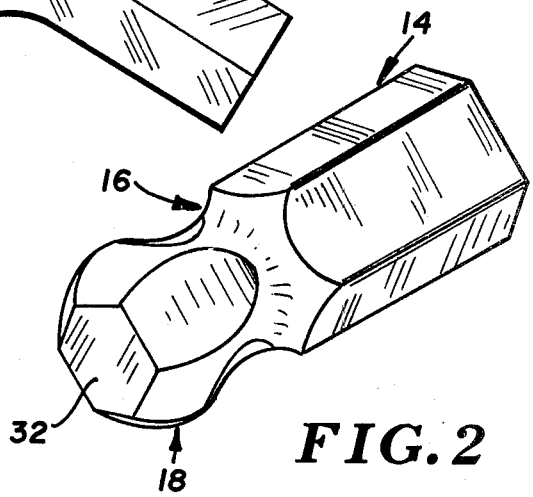
FIG. 2 is a perspective view of the tool.
Figure 3:
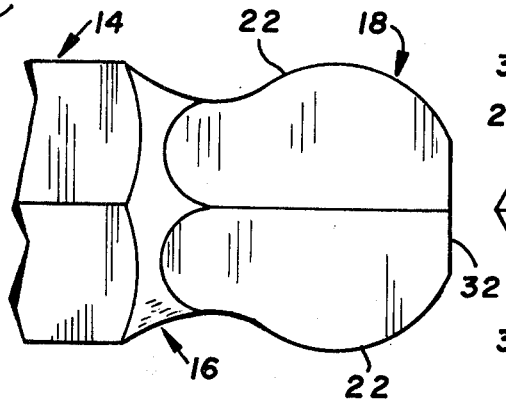
FIG. 3 is a closeup side view of the tool.
Figure 4:
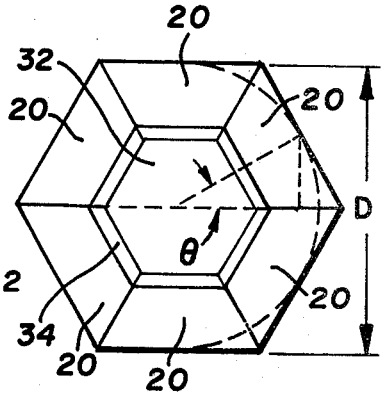
FIG. 4 is an end view of the head portion.

The hex wrench includes a drive shank portion 14, a neck portion 16 and a drive head portion 18, as best seen in FIGS. 1, 2 and 3. The preferable cross section configuration of the hex wrench is an equilateral hexagon, as shown in FIG. 4.

Figure 5:
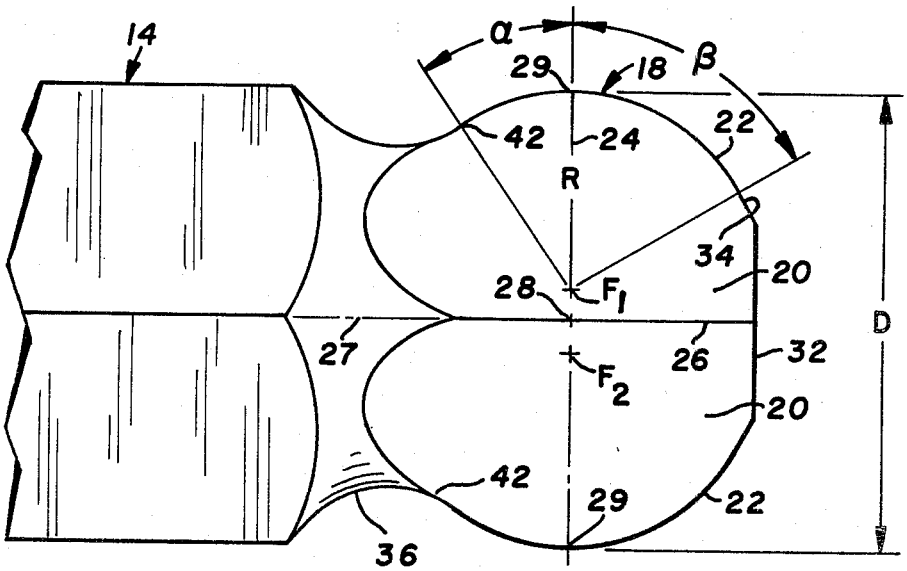
FIG. 5 is a side view that shows the geometrical requirements of the surfaces of the present invention.

The drive head portion 18 has sides 20 with elliptical surfaces 22. The elliptical surfaces 22 substantially conform to the end portions of an ellipse whose minor axis 26 lies along the central axis 27 of the wrench 10. The ellipse defining the elliptical surfaces has two foci $F_1$ and $F_2$, as shown in FIG. 5, and a midpoint 28 defined by the intersection of the major axis 24 and the minor axis 26.

The shape of the ellipse defining the surfaces 22 of the side 20 of the head portion 18 is a function of the number of sides of the wrench. The number of sides 20 is expressed in degrees by the following:

$$\sigma = \frac{360^\circ}{2\ (\text{No. of sides})}.$$

The angle $\sigma$ determines the distance from the midpoint 28 to the foci and the distance from each focus to an intercept 29 of the major axis with the surface 22. In this manner, the number of sides as expressed in $\sigma$ determines the shape of the elliptical surfaces 22.

The relationship is explained by an understanding of an ellipse. In a circle the foci $F_1$ and $F_2$ are at the midpoint of the major and minor axis. As the circle turns, $F_1$ and $F_2$ proceed on the vertical axis, the major axis in an ellipse, away from the midpoint 28. $F_1$ and $F_2$ will proceed along the major axis as the circle turns until the circle turns 90° and $F_1$ and $F_2$ become the vertical intercepts 29 and the circle a flat line. Thus, $F_1$ and $F_2$ are some function of the angle $\sigma$ as shown in FIG. 4 since $\sigma$ is the angle that the circle is turned to form an ellipse. From this understanding, the distance from a focus, $F_1$ or $F_2$, to the nearest intercept along the major axis is defined by $\frac{1}{2}D \cos \sigma$, where D is the distance from one side to an opposing side or as in the preferred embodiment, the width of the hex wrench.

Since the distance from the midpoint 28 to an intercept 29 along the major axis is constant, the distance from the midpoint to either focus $F_1$ or $F_2$ is defined by $\frac{1}{2}D\ (1-\cos \sigma)$ wherein D is the width of the hex wrench, as defined by the distance between opposing sides.

In the preferred embodiment, $\sigma$ is equal to 360°/2(6) or $\sigma=30°$. Thus, the distance from $F_1$ to the nearest intercept along the major axis is equal to $\frac{1}{2}D \cos 30°$ or 0.433D. Likewise, the distance from midpoint 28 to either $F_1$ or $F_2$ is 0.067D.

The head portion 18 is shown as terminating in a flat surface 32. The flat surface 32 can be seen to have the same shape as the cross section of the shank portion 14, or as a hexagon, as in the preferred embodiment. The flat surface 32 has a width preferably as a function of the width of the shank portion. The width is, of course, dependent upon the size of the cap screw with which the wrench is to be used. It is to be understood that while we show a flat end surface 32, the surface can be rounded or take any other suitable form.

Between the end surface 32 and elliptical surface 22 there may be an inclined surface 34 to provide a smooth transition between elliptical surface 22 and flat end surface 32. The inclined surface 34, where provided, is preferably some function of the diameter of the hex wrench. The starting point of the inclined surface is determined by the angle $\beta$ which may be a 60° angle formed with the major axis at either foci, $F_1$ or $F_2$.

The neck portion 16 is a portion formed between the head portion 18 and the shank portion 14. As shown, the neck portion substantially conforms to a portion of a hyperboloid of revolution whose axis of revolution is the central axis 27 of the hex wrench. The neck portion may be the form of an inwardly curved surfce 36 of revolution, however. Where it is feasible to make the head of a larger cross-sectional width than the shank, the neck may simply curve inwardly from the head to the shank. The neck begins at an area of confluence 42 and at that area is tangential to the elliptical surface of the head portion 18.

The area of confluence 42 is spaced from the intercept 29 by an angle $\alpha$ which depends upon the amount of tilting desired. This angle $\alpha$ may vary from 10° to 50° depending upon the extent to which the neck is recessed to obtain more tilting. Obviously, the greater the angle $\alpha$ is, the smaller will be the neck and the more tilting will be possible. Where it is desired to have a thicker neck for purposes of strength and where a large amount of tilting is not necessary, the angle $\alpha$ will be relatively small.

It has been found that by making the surface of the head elliptical with the elements of the ellipse related, as described above, to the numbers of sides of the tool, it is possible to obtain a much greater tilting without bending of the wrench as it is used than has previously been possible. In actual practice, curved surfaces 22 need not be strictly elliptical. They can be arcs of a circle with a center of curvature at the point $F_1$, rather than along the center line 28 as would normally be the case. As has been explained above, the distance between the point $F_1$ and the midpoint 28 is dependent upon the number of sides. If one had an infinite number of sides, this distance would be zero and the surfaces 22 would be arcuate surfaces with the centers of curvature at the midpoint 28. The fewer the number of sides, the greater will be the displacement of the center of curvature of the surface 22 from the midpoint 28. By providing a surface of this type, closely approaching a portion of an elliptical surface, it is possible, as explained above, to get a very substantial degree of tilting of the tool as the tool is turned without binding between the head of the tool and the socket of the screw with which the tool is being used.

While we have shown a specific embodiment of the invention for purposes of illustration, it is to be understood that the invention is limited solely by the scope of the appended claims.

What is claimed is:

1. A wrench with a polygonal cross section comprising:

a drive shank portion having a longitudinal central axis; and a drive head portion secured to said shank portion and having a plurality of curved sides disposed polygonally with the outermost portions of said sides being spaced from the longitudinal central axis by a distance of $\frac{1}{2}D$ and with the center of curvature of each curved side being displaced from said longitudinal central axis by a distance substantially equal to $\frac{1}{2}D\ (1-\cos \sigma)$ where $$\sigma = \frac{360^\circ}{2\ (\text{No. of sides})}.$$

2. The wrench of claim 1 in which curved sides of the drive head portion substantially conform with an end portion of an ellipse having the longitudinal central axis as a minor axis and with the distance from each focus of the ellipse to the central axis being equal to $\frac{1}{2}D\ (1-\cos \sigma)$.

3. The wrench of claim 1 in which there is a neck portion joining the drive head portion and the drive shank portion and having a surface correspondng to an inwardly curved surface of revolution.

4. The wrench of claim 3 wherein the surface of the neck portion is tangential to the surface of the drive head portion at the point of confluence.

5. The wrench of claim 3 in which the inwardly curved surface of the neck portion substantially conforms with a portion of a hyperboloid of revolution whose axis of revolution is said central axis.

6. The wrench of claim 1 wherein the drive head portion further comprises:

a flat inclined portion having a plurality of sides corresponding to the number of curved sides of the head portion and adjacent to the ends of the curved sides; and a substantially flat end surface defining the lower end of the inclined flat portion.

7. The wrench of claim 6 wherein the angle between a line perpendicular to the central axis and a line drawn from the center of curvature through the point of confluence of the head portion with the inclined portion is approximately 60°.

8. The wrench of claim 1 wherein there are six equal sides on both the head portion and the shank portion, said sides being disposed to form an equilateral hexagon.

* * * * *